United States Patent [19]

Loudin

[11] 4,267,941

[45] May 19, 1981

[54] BREATHER CAP

[75] Inventor: Philip B. Loudin, Palos Hills, Ill.

[73] Assignee: Illinois Tool Works Inc., Chicago, Ill.

[21] Appl. No.: 106,596

[22] Filed: Dec. 26, 1979

[51] Int. Cl.[3] ..... B65D 6/12; B65D 6/40; B65D 25/00; B65D 90/12

[52] U.S. Cl. ..... 220/85 SP; 220/293; 220/367; 220/295; 222/569

[58] Field of Search ..... 220/85 SP, 293, 295, 220/302, 303, 307, 367; 222/567, 566, 569; 123/41.86, 119 B; 217/107, 98

[56] References Cited

U.S. PATENT DOCUMENTS

| | | | |
|---|---|---|---|
| 3,263,876 | 8/1966 | Perfetto | 222/569 |
| 3,672,547 | 6/1972 | Kozlowski | 220/85 SP |
| 3,951,318 | 4/1976 | Costa | 222/569 |
| 4,020,970 | 5/1977 | Koscik et al. | 220/293 |

*Primary Examiner*—George T. Hall

*Attorney, Agent, or Firm*—Thomas W. Buckman; Jack R. Halvorsen

[57] ABSTRACT

A unitary plastic cap having an inner and outer sealing flange surrounding means for compressively engaging the cap with an apertured member. Upon compression, the inner and outer flanges of the cap cooperate with a raised annular ridge disposed radially outward of the aperture on the member to provide a double sealing engagement of the cap with the member.

6 Claims, 4 Drawing Figures

BREATHER CAP

BACKGROUND OF THE INVENTION

In the field of internal combustion engines there are a plurality of access ports which communicate with various portions of the engine, for example, an oil filler hole or a crankcase vent wherein fumes from the crankcase are fed via a tubular member to the combustion system of the engine. A common device for closing such access ports is generally a rotatable cap consisting of several pieces, generally metallic, which often require special preparation of the aperture with which they are associated. Such devices will generally include a single spring-loaded gasket or similar means for purposes of sealing the closing member relative to the access port and providing a barrier to the passage of oil and fumes. Due to the metallic nature of this prior art, the closure means or caps become quite hot from the operating temperature of the engine and hence require insulating means to protect the hand of the mechanic servicing the engine. Failure of such devices often occurs due to the spring fatigue in the locking means as well as failure of the gasket due to wear and repeated compression. In addition, the complex operations required to form the collars and facing elements on the apertures used with prior art caps increases the manufacturing cost of the engine.

As the prior art caps employ a single gasket or sealing member, a failure thereof or momentary overpressure may cause the communication of fumes or fluids through the barrier.

Due to the increased reliance upon such caps to maintain positive crankcase pressure and to meet other requirements placed upon the modern automobile engine, failure of the sealing function presents a substantial impediment to the proper operation of the engine.

SUMMARY OF THE INVENTION

It is an object of the present invention to provide a unitary plastic cap with a double seal for closing access ports which is economical and reliable and which is used in a simple stamped hole instead of the formed holes previously used.

A further object of the present invention is to provide a cap with a double barrier to the undesired release of oil and fumes from an engine.

Other objects of the present invention will be apparent to those skilled in the art and all mechanical equivalents.

DETAILED DESCRIPTION OF THE INVENTION

Figure 1:
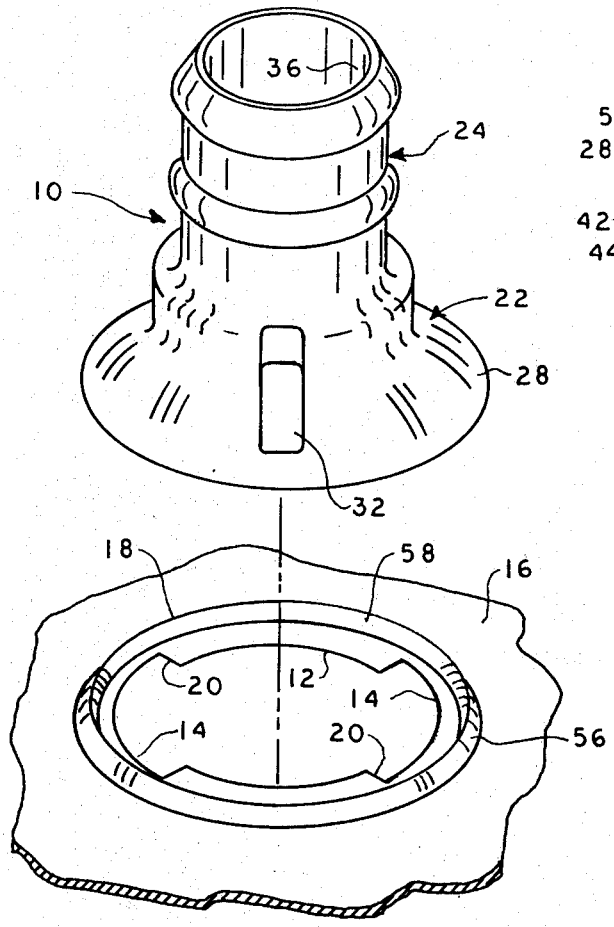
FIG. 1 is an exploded perspective view, in partial section, of a preferred embodiment of the present invention along with an apertured member with which it is to be associated.

Referring now to the drawings, a closure device for access ports as contemplated by the present invention would include a cap 10, which is adapted to be associated with an aperture 12 having one or more arcuate notches 14 communicating with the aperture 12. Such an aperture may be formed in a flat member 16 such as that in a rocker cover in an automobile engine. An annular ridge 18 is embossed in member 16 and disposed around and concentric with aperture 12. The juncture of the notches 14 with the aperture 12 provides one or more stops or shoulders 20 for purposes best set forth hereinafter.

The cap 10 can be injection molded using normal procedures and standard resilient thermoplastic materials, such as nylon, or other materials which are compatible with the temperatures and fluids encountered in a particular environment.

Figure 2:
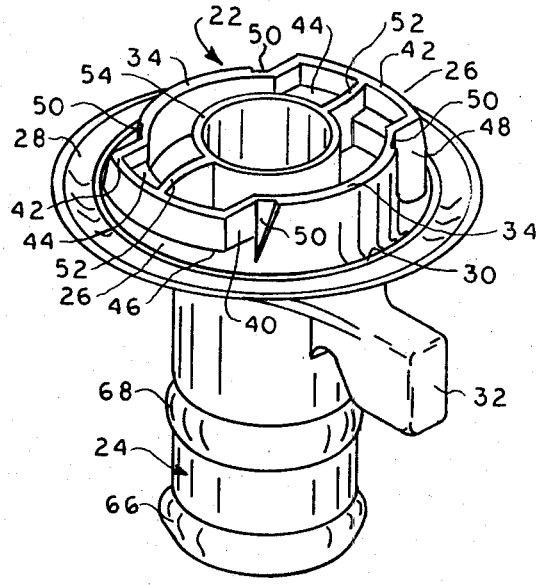
FIG. 2 is a perspective view of the sealing elements and the retaining means of the preferred embodiment.
Figure 3:
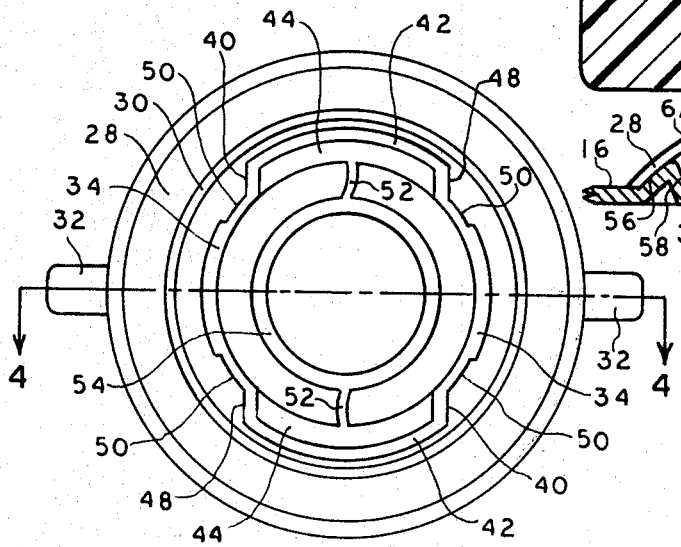
FIG. 3 is a plan view of the preferred embodiment.
Figure 4:
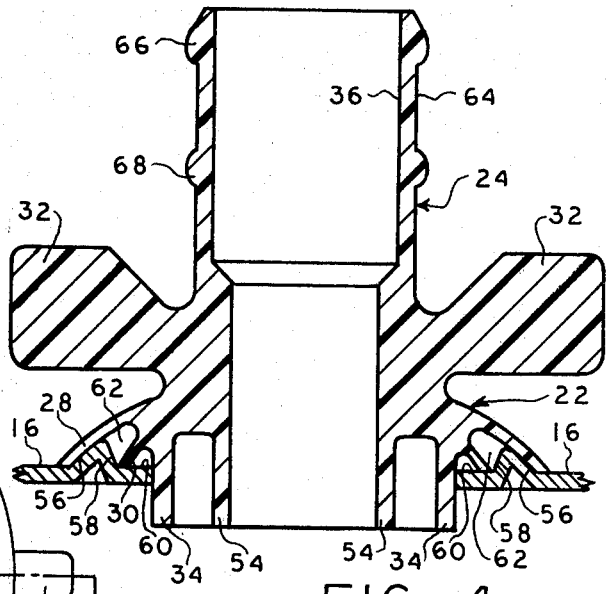
FIG. 4 is an elevational view in section taken along line 4—4 of FIG. 3.

Referring now to FIGS. 2–4, the cap 10 includes a body portion 22; a head portion 24; one or more retaining pads 26; outer sealing element 28 and inner sealing element 30 extending generally laterally from the juncture of the body 22 and head 24; and rotation inducing means 32, in the present embodiment laterally extending finger engaging means carried on the head 24.

It will be noted that the sealing element 28 is arcuate in cross-section and that each of sealing elements 28 and 30 is circumferentially disposed to provide an endless seal surrounding the cap 10.

The body 22 of cap 10 is provided with opposed thickened wall portions 34 disposed circumferentially over a limited segment of the body 22 and extending from said body in an axial direction. The outer dimension of wall portions 34 is acceptable for rotation within the aperture 12. Extending axially from the body 22, in a direction opposite wall portions 34, is the head portion 24 with a central through bore 36 passing through the entire extent of body 22 and head 24.

Extending outwardly from the body 22, in spaced relation to the sealing elements 28 and 30, are one or more retainer pads 26. The retainer pad 26 includes side element 40, an end element 42, and a top bearing element 44 interconnecting the side elements 40 and the end element 42 with the bearing element 44 facing the concavity of sealing elements 28 and 30. At one end of the bearing element 44 is a lead-in or cam surface 46 and at the opposite end of bearing element 44 a vertically disposed stop 48, which extends between the bearing element 44 and sealing element 30.

The side elements 40 of the retainer pad 26 are connected to the body 22 and the thickened wall portion 34 by a thinned tapered hinge or flexible portion 50. It will be noted that this flexible portion 50 is tapered in a diverging manner from the juncture of the body 22 with sealing element 30 off to the free end. This tapering provides the uniform stress distribution as well as giving a substantially uniform flexing of the retainer pad 26 away from the inner sealing element 30 when the part is introduced into the aperture and rotated.

To insure an aggressive flexure of retainer pads 26, it is necessary to provide secondary spring means which will reinforce and provide a reactive force against the flucture of retainer pads 26. In the present embodiment, this takes the form of a modified arcuate leaf compression spring 52 which is integrally connected to the interior surface of end element 42 at one of its ends while the opposite end is connected to and acts against a stiffening annular ring 54 spaced radially inwardly from and axially disposed in the same direction as body 22.

When the cap 10 is introduced into the aperture 12, the retainer pads 26 are telescoped into the slots 14 and it is possible, by rotation in a clockwise manner, to cause the retainer pads to underlie the panel by first riding up the cam surface 46, causing a flexure of the retainer pads 26. Rotation is continued until the stop 48 is brought to bear against the shoulder 20 forming one end of the slot 14. The flexure of the retainer pads 26 will cause a deflection of the spring 52 and simultaneously therewith will cause the sealing elements 28 and 30 to flex axially to bring sealing elements 28 and 30 into intimate relationship with member 16 and annular ridge 18 as more fully hereinafter described.

According to the present invention, the cap 10 includes a novel configuration of outer sealing element 28 and inner sealing element 30 disposed around body portion 22 and tapering generally laterally therefrom. As is seen in FIG. 4, the outer sealing element 28 is arcuate in cross-section and upon compression seals tightly against a mating outer wall 56 of the annular ridge 18 and against the surface of member 16. Due to its resilient nature, the outer seal 28 conforms itself to the outer wall 56 to provide a surface seal of increased strength and efficiency. The inner sealing element 30 is positioned below the outer seal 28 and, upon compression, is wedged firmly between an inner wall 58 of annular ridge 18 and the adjacent section 60 of member 16 to provide an end seal against the member 16.

Due to the resilient nature of sealing elements 28 and 30, the cooperating shape of annular ridge 18 and the member 16, and the compressive engagement of said sealing elements and said member as hereinbefore described, the cap 10 effects a superior barrier to the passage of oil and fumes. As gasses or fluids attempt to pass the juncture of inner sealing element 30 and the member 16, the pressure of the attempted egress forces the inner seal 30 against the inner wall 58, which increases the effective seal therebetween. Should a momentary extreme pressure cause such fluids to pass the inner seal 30, they are trapped in a void 62 which is formed between outer element 28 and inner element 30, and then are contained by outer sealing element 28. Thus, a momentary overpressure cannot cause a continuous escape path and the sealing qualities of the cap are greatly improved.

In this embodiment, the head portion 24 of cap 10 includes a cylindrical wall 64 which defines through bore 36 extending therethrough. The wall 64 includes annular rings 66 and 68 adapted to retain a tubular member or hose, not shown, in communication with the through bore 36. The through bore 36 continues through the body portion 22 of cap 10 to allow the passage of fumes, when desired, through said through bore and the tubular member to other sections of the engine. However, it is to be understood that in other embodiments of the present invention, the cap 10 may terminate in an imperforate solid piece to prevent the egress of fumes and completely seal the access port.

Thus, as these parts may be made interchangeable, a plurality of apertures can be prepared in a specific engine block or cover and either a vented plug or a closing plug can be employed depending upon the particular model of car being produced.

Other variations than those referred to herein will be apparent to those skilled in the art.

The invention is claimed as follows:

1. A unitary plastic cap for covering an aperture in a member having a raised annular ridge disposed radially outwardly of said aperture and including relatively inner and outer walls joining said member, said cap comprising: (a) retaining means for extending through said aperture and compressively engaging said cap against said member, and (b) an endless outer sealing element having a diametral extent greater than said annular ridge for sealingly engaging against said outer wall, and (c) an endless inner sealing element having a diametral extent less than said annular ridge for sealingly engaging against said member.

2. A unitary plastic cap for covering an aperture in a member having a raised annular ridge including relatively inner and outer walls joining said member and disposed radially outwardly of said aperture, said cap comprising: (a) a head portion adapted to be rotated during assembly with said member, (b) a body portion for traversing said aperture and rotatable with said head portion, said body portion having: (1) an endless outer sealing element having a diametral extent greater than said annular ridge for sealingly engaging said outer wall, and (2) an endless inner sealing element having a diametral extent less than said annular ridge for sealingly engaging against the juncture of said inner wall and said member, and (c) retaining means connected with said body portion for extending through said aperture and compressively engaging said body portion against said member.

3. A unitary plastic cap for covering an aperture in a member having a raised annular ridge including relatively inner and outer walls joining said member and disposed radially outwardly of said aperture, and at least one auxiliary notch opening into said aperture, said cap comprising: (a) a head portion having rotation inducing means; (b) a body portion rotatably accepted within said aperture; (c) an endless outer sealing element extending radially from said body and having a diametral extent greater than said annular ridge for sealingly engaging said outer wall; (d) an endless inner seal element extending radially from said body and having a diametral extent less than said annular ridge for sealingly engaging juncture of said inner wall and said member upon engagement; and (e) at least one flexible retaining pad extending radially from said body and acceptable within said at least one notch, and flexing resiliently to compressively engage said cap with said member.

4. A unitary plastic cap for covering an aperture in a member having a raised annular ridge disposed radially outwardly of the margin of said aperture, said ridge including relatively inner and outer walls joining said member, and at least one auxiliary notch opening into said aperture, said cap including: (a) a body rotatably acceptable within said aperture; (b) a head portion having rotation inducing means; (c) an endless outer sealing element having a diametral extent greater than said annular ridge in sealing against the outer wall thereof upon engagement; (d) an endless inner sealing element having a diametral extent less than said annular ridge in sealing against the juncture of said inner wall and said member upon engagement; and (e) at least one flexible retainer pad acceptable within said at least one notch and extending laterally from said body in a predetermined spaced relation to said sealing elements, capable of resilient flexure to accommodate said ridge between said at least one pad and said sealing elements when said cap is rotated to cause said pad to underlie said member, and transversely disposed resilient means for controlling the flexure of said pads.

5. A cap according to claim 2, 3 or 4 wherein said cap further comprises means defining a central bore extending axially through said body and said head portion, and retaining means to engage a tubular member in communication with said central bore.

6. A cap according to claim 1, 2, 3 or 4 wherein at least one of said sealing elements includes a flange joining said body and tapering from said body toward the outer perimeter of said flange.

* * * * *